US010150290B2

(12) United States Patent
Kasai et al.

(10) Patent No.: US 10,150,290 B2
(45) Date of Patent: Dec. 11, 2018

(54) PRINT ELEMENT SUBSTRATE AND PRINTING DEVICE

(71) Applicant: CANON KABUSHIKI KAISHA, Tokyo (JP)

(72) Inventors: Ryo Kasai, Tokyo (JP); Kengo Umeda, Tokyo (JP); Takatsuna Aoki, Yokohama (JP); Makoto Takagi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/602,671

(22) Filed: May 23, 2017

(65) Prior Publication Data

US 2017/0341382 A1 Nov. 30, 2017

(30) Foreign Application Priority Data

May 30, 2016 (JP) ..... 2016-107638
Apr. 27, 2017 (JP) ..... 2017-088816

(51) Int. Cl.
*B41J 2/14* (2006.01)
*B41J 2/045* (2006.01)

(52) U.S. Cl.
CPC ..... *B41J 2/04563* (2013.01); *B41J 2/0458* (2013.01); *B41J 2/04528* (2013.01); *B41J 2/04541* (2013.01); *B41J 2/14072* (2013.01); *B41J 2/14088* (2013.01)

(58) Field of Classification Search
CPC .. B41J 2/04563; B41J 2/0458; B41J 2/14088; B41J 2/04528; B41J 2/04596; B41J 2/04598
See application file for complete search history.

(56) References Cited

U.S. PATENT DOCUMENTS 9,039,126 B2 5/2015 Hirayama et al.
9,597,893 B2 3/2017 Kudo et al.
2014/0300660 A1* 10/2014 Hirayama ..... B41J 2/072 347/17

FOREIGN PATENT DOCUMENTS

JP 2014-200972 A 10/2014

OTHER PUBLICATIONS

U.S. Appl. No. 15/590,489, filed May 9, 2017.

* cited by examiner

*Primary Examiner* — Jason Uhlenhake
(74) *Attorney, Agent, or Firm* — Venable LLP

(57) ABSTRACT

A print element substrate and a printing device which can suppress lowering of an image quality are provided. For that purpose, a heater, a sub-heater, and a driver are arranged in each heating area, and a plurality of the heating areas is arrayed on the print element substrate.

20 Claims, 7 Drawing Sheets

PRINT ELEMENT SUBSTRATE AND PRINTING DEVICE

BACKGROUND OF THE INVENTION

Field of the Invention

The present invention relates to a printing device which performs printing by ejecting a liquid by driving a print element and to a print element substrate used for the printing device, and for details, it relates to a print element substrate on which a plurality of the print elements and a drive circuit for driving each of the print elements are provided on the same print element substrate and to a printing device.

Description of the Related Art

The print element substrate used for the printing device which performs printing by ejecting a liquid executes substrate temperature control in response to a recent request for a higher image quality. In the print element substrate, a liquid droplet amount or an ejection speed of the ejected liquid fluctuates depending on the temperature. Thus, in a case where temperature distribution occurs in a substrate temperature, the temperature distribution directly causes unevenness of an image and lowers the image quality.

As a method of correcting the temperature distribution of the substrate, Japanese Patent Laid-Open No. 2014-200972 discloses a method of suppressing temperature unevenness in the substrate by arbitrarily heating a specific area in the substrate. Moreover, there is also disclosed a method of heating a plurality of areas without increasing a connection terminal which can be connected to an outside of the substrate by mounting a driver of a sub-heater in the print element substrate.

However, the driver generates a certain amount of heat while driving the sub-heater. With the constitution in Japanese Patent Laid-Open No. 2014-200972, since the driver is arranged in a concentrated manner on one side end of the print element substrate, a temperature of the one side end of the print element substrate rises by the heat generation during driving of the sub-heater. As a result, there is a concern that temperature unevenness occurs in the substrate and it lowers the image quality.

SUMMARY OF THE INVENTION

Thus, the present invention provides a print element substrate and a printing device which can suppress lowering of an image quality.

Thus, the print element substrate of the present invention is a print element substrate which ejects a liquid droplet from an ejection port by foaming the liquid, including: a first heating unit row in which a plurality of first heating units used for foaming the liquid is arrayed; a second heating unit row in which a plurality of second heating units provided in a vicinity of the first heating units and used for heating the print element substrate is arrayed along the first heating unit row; and a driving unit row in which a plurality of driving units for driving the second heating units is arrayed along the first heating unit row.

According to the present invention, the print element substrate and the printing device which can suppress lowering of the image quality can be realized.

Further features of the present invention will become apparent from the following description of exemplary embodiments with reference to the attached drawings.

DESCRIPTION OF THE EMBODIMENTS

First Embodiment

Figure 1A:
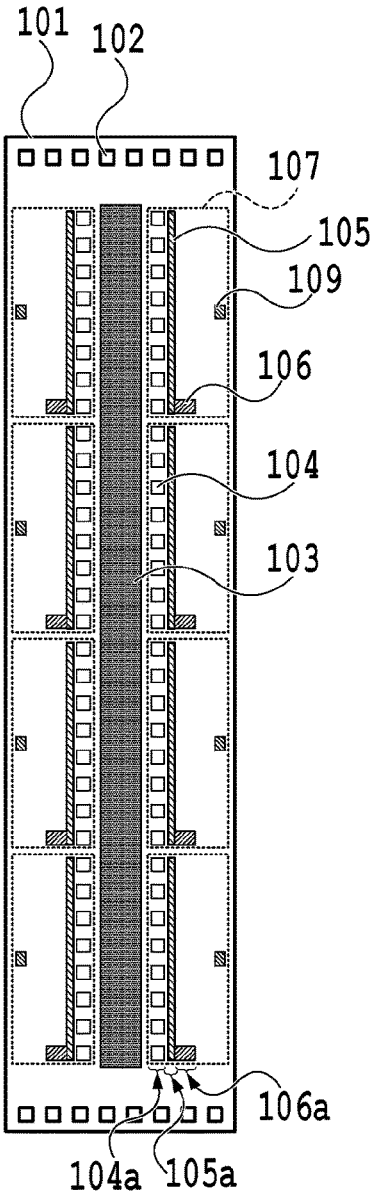
FIG. 1A is a view illustrating a print element substrate.

A first embodiment of the present invention will be described below by referring to the drawings.

FIG. 1A is a view illustrating a print element substrate 101 of this embodiment. On the print element substrate 101, a pad (connection terminal) 102 which is a connection terminal to an outside is provided on an end portion of the substrate, and the pad 102 includes a signal terminal receiving selection data of a heater 104 driven for ejection, a power supply terminal and the like. At a center part of the print element substrate 101, a supply port 103 for supplying a liquid to be ejected is provided and it supplies the liquid to an upper layer of a heater (first heating unit) 104. Ejection ports form a row so as to form an ejection port row, and the ejection port is formed immediately above the heater 104. Then, it is formed such that an electric current is caused to flow through and heat the heater 104 so as to heat the heater 104 at arbitrary timing, and thereby the liquid is heated and foamed and a liquid droplet can be ejected from the ejection port. A sub-heater (second heating unit) 105 is an element for heating and keeping warm the print element substrate 101 and the liquid. A driver (driving unit) 106 is connected to the sub-heater 105 and turns ON/OFF the current that flows through the sub-heater 105.

In the print element substrate 101, a plurality of heating areas (regions) 107 is provided equally on right and left of the substrate, and in each of the heating areas (regions) 107, a temperature detection element (temperature detection unit) 109, the sub-heater 105, and the driver 106 are provided, respectively. The temperature detection element 109 is provided one for one heating area 107 and detects temperature distribution of the print element substrate 101. A positional relationship among the heater 104, the sub-heater 105, and the driver 106 in each of the heating areas 107 is the same in all the heating areas 107. By arranging them as above, heat generation among the plurality of heating areas 107 can be made equal easily, which is more preferable. Note that this is not limiting and it is only necessary that predetermined numbers of the heaters 104, the sub-heaters 105, and the drivers 106 are accommodated in one heating area 107.

Figure 1B:
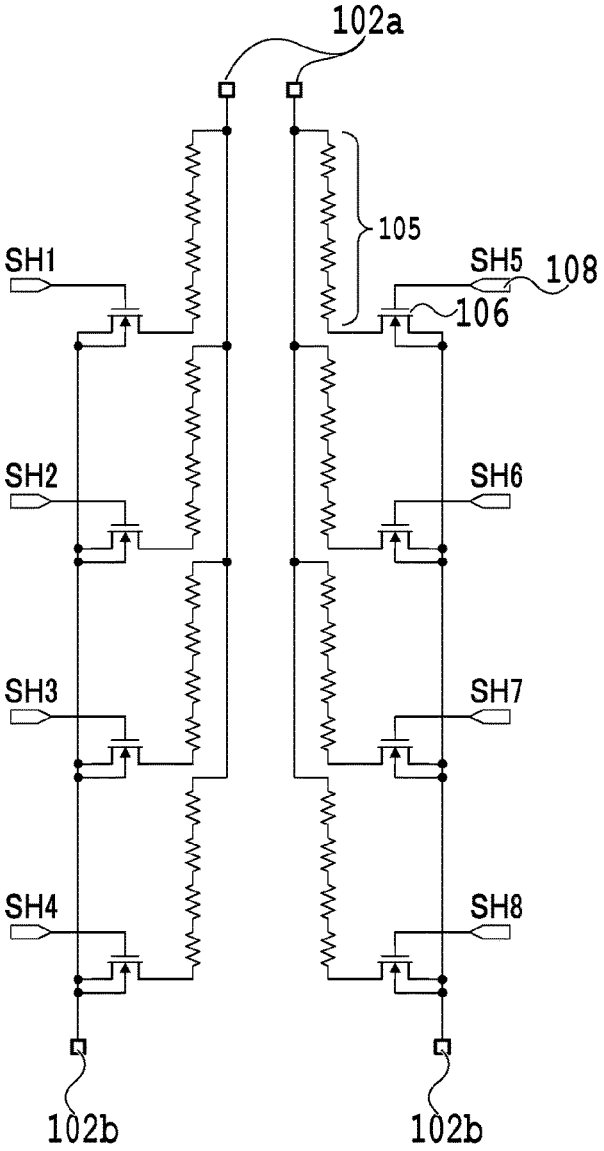
FIG. 1B is a view illustrating a drive circuit of a sub-heater in the print element substrate.

FIG. 1B is a view illustrating a circuit for driving the sub-heater 105 in the print element substrate 101. A pad 102*a* is a + power supply pad, while a pad 102*b* is a GND pad. These power supply pads 102*a* and 102*b* are used for supplying electricity to the sub-heater 105, but may be shared with a pad used for supplying electricity to the heater 104 used for liquid droplet ejection (as the same power supply). The driver 106 is controlled by a sub-heater control signal 108 to drive the sub-heater 105, thereby heating the arbitrary heating area 107 located at eight spots in the print element substrate 101. The sub-heater control signal 108 may be generated by being converted from a data signal in the print element substrate 101 or may be supplied from an outside of the print element substrate 101 through the pad 102.

Figure 1D:
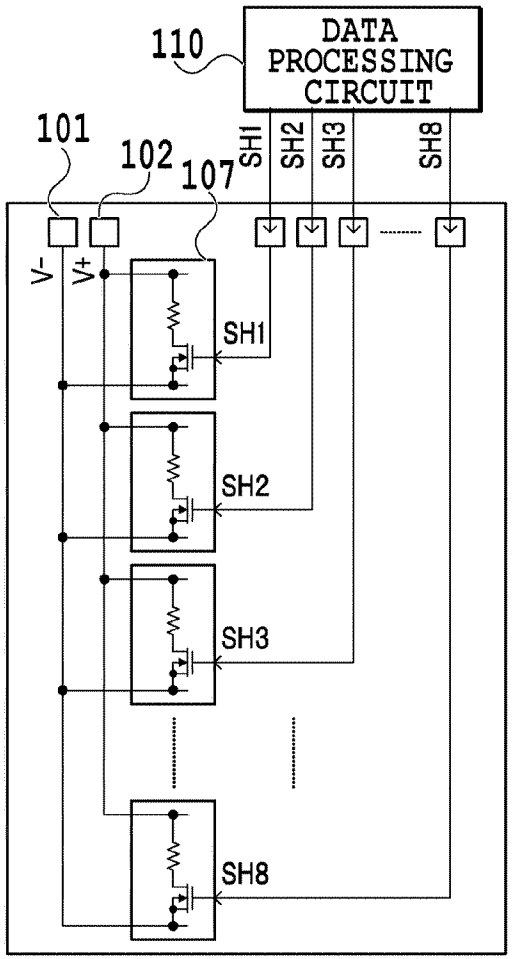
FIG. 1D is a block diagram illustrating a state where the sub-heater control signal is supplied from outside the print element substrate.
Figure 1C:
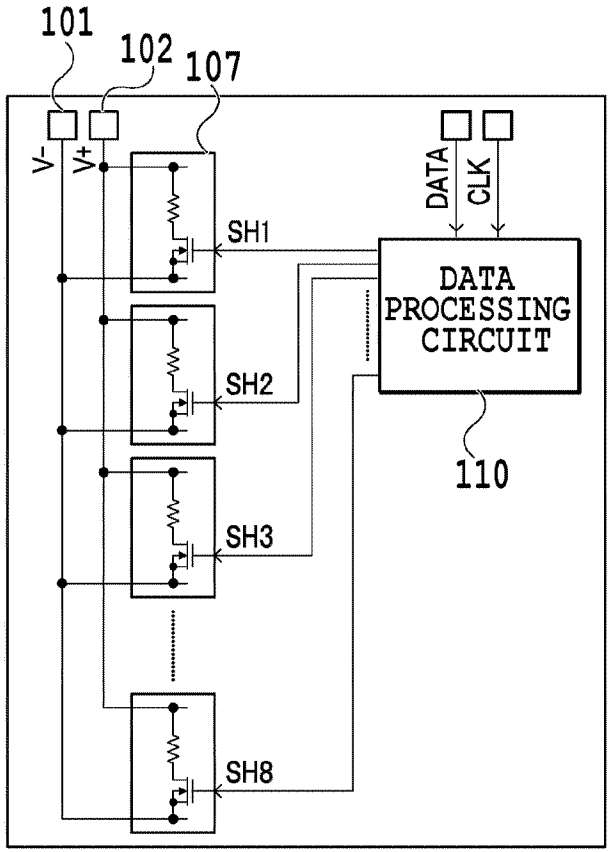
FIG. 1C is a block diagram illustrating a state where a sub-heater control signal is generated in the print element substrate.

FIG. 1C is a block diagram illustrating a state where the sub-heater control signal 108 is generated in the print element substrate 101, and FIG. 1D is a block diagram illustrating a state where the sub-heater control signal 108 is supplied from outside the print element substrate 101. In FIG. 1C, a data processing circuit 110 for generating the sub-heater control signal 108 is provided in the print element substrate 101, and in FIG. 1D, the data processing circuit 110 is provided outside the print element substrate 101. In a case where the sub-heater control signal 108 is generated in the print element substrate 101, the sub-heater control is enabled without increasing the pads 102 by sending control signal data at the same time as image data. The sub-heaters 105 and the drivers 106 are arranged by forming rows in a direction of a long side of the print element substrate 101, respectively, and shortest distances to an edge of the liquid supply port 103 are provided equally.

In the print element substrate 101 of this embodiment, a row 105*a* (second heating unit row) of the sub-heaters 105 in which a plurality of the sub-heaters is arrayed is provided along a row 104*a* (first heating unit row) of the heaters 104 in which the plurality of heaters 104 is arrayed. Moreover, a row 106*a* (driving unit row) of the drivers 106 in which a plurality of the drivers 106 is arrayed is provided along the row 104*a* of the heaters 104. As a result, temperature unevenness in the print element substrate 101 can be suppressed by heating the print element substrate 101 by the sub-heaters 105, and further, occurrence of the temperature unevenness involved in arrangement of the drivers 106 can be suppressed.

Note that, in this embodiment, constitution including the temperature detection element in the heating area is described, but this is not limiting, and a temperature of the heating area may be detected from an outside, for example.

As described above, in this embodiment, the heater 104, the sub-heater 105, and the driver 106 are arranged for each heating area 107, and further, the plurality of heating areas 107 is arrayed on the print element substrate. As a result, the print element substrate and the printing device which can suppress lowering of an image quality were realized.

Second Embodiment

A second embodiment of the present invention will be described below by referring to the drawings. Note that, since a basic constitution of this embodiment is similar to that of the first embodiment, only characteristic constitution will be described below. In the constitution of the first embodiment, the temperature distribution of the print element substrate 101 can be uniformly controlled but in a case of paying attention to an inside of the heating area 107, the temperature distribution is biased in the heating area 107 due to heat generation of the driver 106, and it is likely that the image quality is lowered. Thus, in this embodiment, bias of the temperature distribution in the heating area is suppressed, and further, a size reduction of the sub-heater is also realized.

Figure 2A:
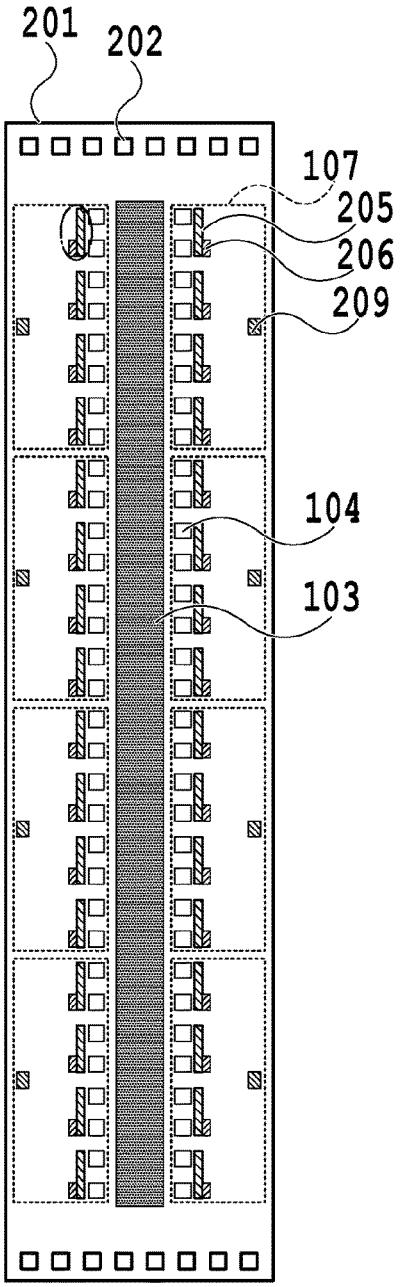
FIG. 2A is a view illustrating the print element substrate.

FIG. 2A is a view illustrating a print element substrate 201 of this embodiment. In the print element substrate 201 in this embodiment, four units of a pair of a sub-heater 205 and a driver 206 (hereinafter, referred to as a unit 207) per heating area 107 are arranged.

Figure 2B:
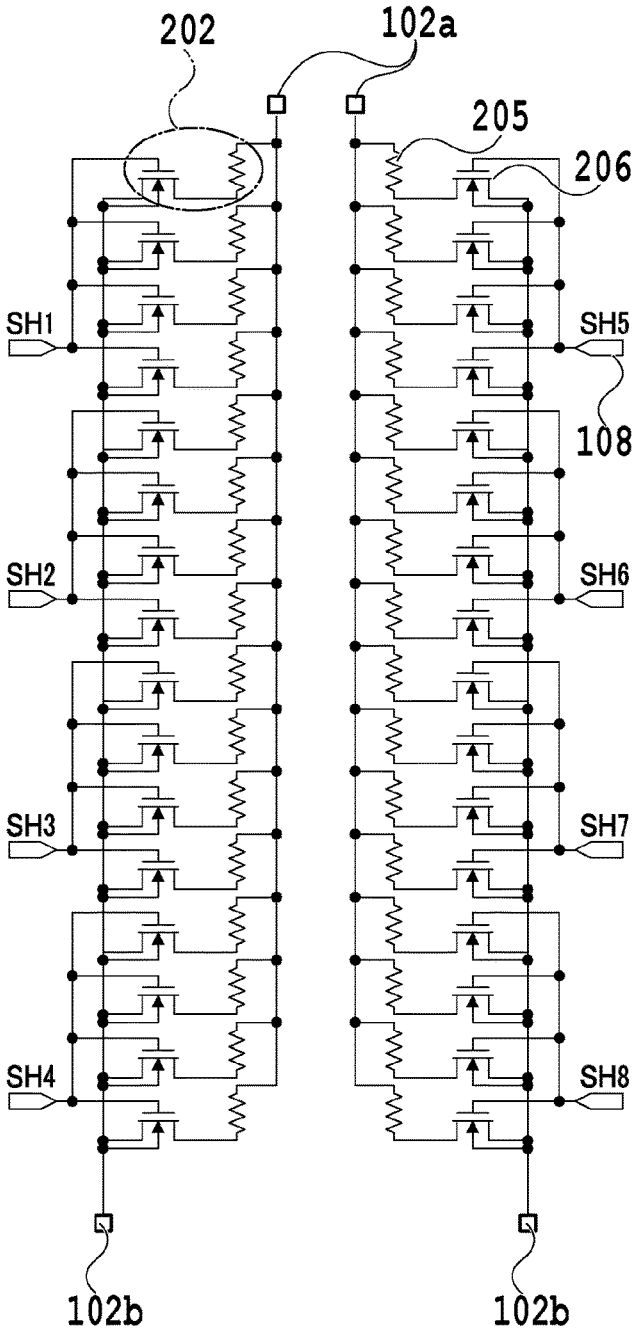
FIG. 2B is a view illustrating the drive circuit of the sub-heater in the print element substrate.

FIG. 2B is a view illustrating a circuit for driving the sub-heater 205 in the print element substrate 201. Four sub-heaters 205 are connected in parallel each through the driver 206, and further, four drivers 206 arranged in one heating area 107 are controlled by the same sub-heater control signal 108. That is, it is constituted such that the plurality of sub-heaters 205 can be driven for each of the heating areas 107. By heating the heating areas 107 by a plurality of units as described above, the drivers 206 which are heat generating sources are also distributedly arranged, and bias of the temperature distribution in the area can be suppressed. Thus, in the constitution of this embodiment, a driver size (area) should have been increased in design to lower resistance in order to suppress heat generation, but it is no longer necessary, and the size of the driver 206 can be reduced. Moreover, by connecting the plurality of units in the heating area 107 in parallel, the size of the sub-heater 205 can be also reduced.

Note that, in this embodiment, the four pairs (units) of the sub-heaters 205 and the drivers 206 are provided in the heating area 107, but this is not limiting, and it is only necessary that a plurality of units is provided in accordance with a use situation.

Assuming that a calorific value per heating area 107 in the print element substrate 101 in FIG. 1A is W, a resistance value of one sub-heater is Rsh1, a resistance value of one driver is Ron1, and a voltage is V, the calorific value W can be expressed as in the following Formula 1:

$$W=(V^2)/(Rsh1+Ron1) \quad \text{(Formula 1).}$$

Since the print element substrate 201 in FIG. 2A has a circuit constitution of four-parallel connection, the calorific value W per heating area 107 can be expressed as in the following Formula 2:

$$W=4\times((V^2)/(4\times Rsh1+4\times Ron1)) \quad \text{(Formula 2).}$$

From the Formula 2, it is known that such that the resistance value of the sub-heater 205 needs to be designed to be four times that of the sub-heater 105 in FIG. 1A, and the resistance value of the driver 206 needs to be designed to be four times that of the driver 105 in FIG. 1A. As a result, a size of one driver 206 is ¼ of the driver 105, but since there are four drivers 206 per one heating area 107, a total area does not change. Regarding the sub-heater 205, the resistance value needs to be four times that of the sub-heater 105, but since a sub-heater length is ¼, thickness of the sub-heater 205 becomes 1/16 of the thickness of the sub-heater 105, and drastic reduction of the sub-heater size can be realized.

As described above, the heater 104, the sub-heater 105 and the driver 106 are arranged as a plurality of units in each of the heating areas 107, and further, a plurality of the heating areas 107 is arrayed on the print element substrate.

As a result, the print element substrate and the printing device which can suppress lowering of the image quality were realized.

Third Embodiment

A third embodiment of the present invention will be described below by referring to the drawings. Note that, since a basic constitution of this embodiment is similar to that of the first embodiment, only characteristic constitution will be described below.

Figure 3A:
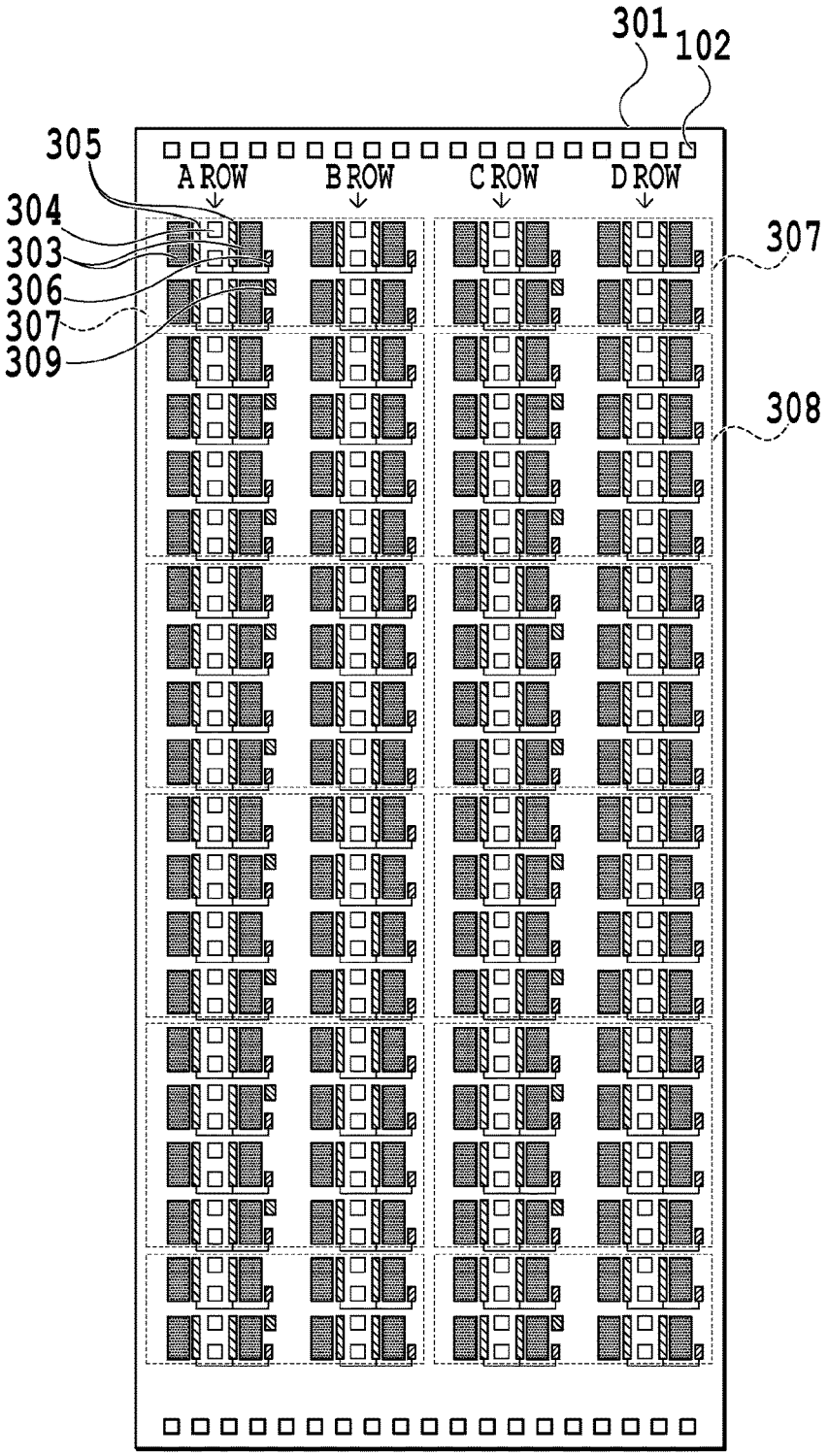
FIG. 3A is a view illustrating the print element substrate.
Figure 3C:
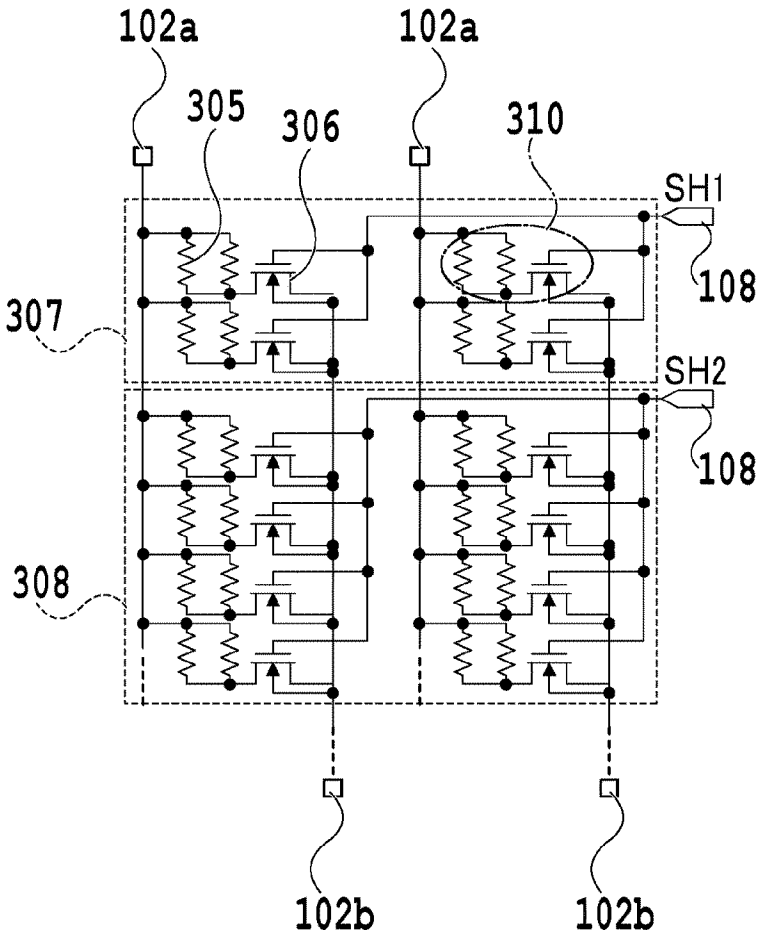
FIG. 3C is a view illustrating the drive circuit of the sub-heater in the print element substrate.
Figure 3B:
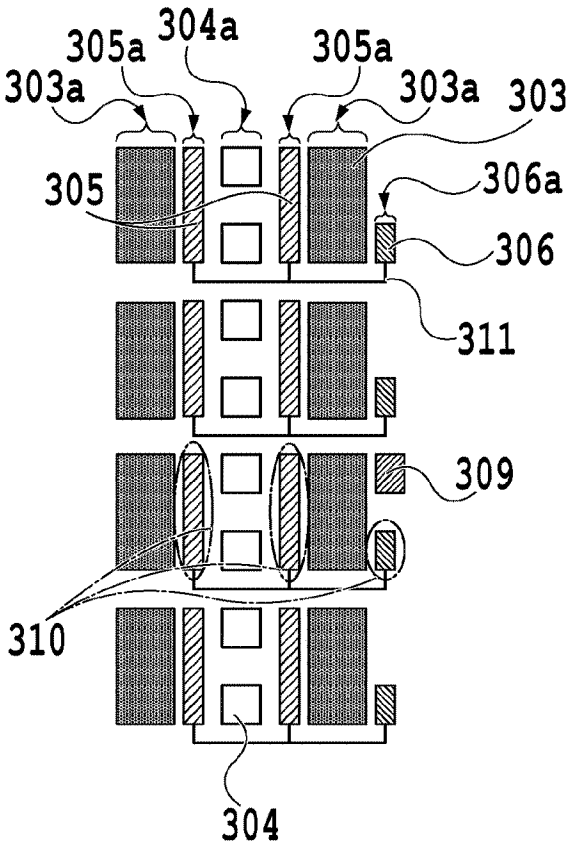
FIG. 3B is an enlarged view of a heating area.

FIG. 3A is a view illustrating a print element substrate 301 of this embodiment and FIG. 3B is a partially enlarged view of a heating area 308. In the print element substrate 301 of this embodiment, independent supply ports 303 are arrayed on both sides of heaters 304 (heater row). Since the independent supply ports 303 have a symmetrical structure with respect to the heaters 304, foaming of the liquid also becomes symmetrical, and the ejected liquid hits a paper surface with high accuracy, thereby a high image quality can be realized. Moreover, since the liquid supply after ejection is performed from the independent supply port 303 on the both sides, an ejection frequency can be raised, and higher speed can be also realized. Moreover, the units (the sub-heaters and the drivers) are arranged equally in the heating area. In this embodiment, arrangement of the sub-heater in such a layout will be described.

Sub-heaters 305 are arranged on both sides of the heaters 304 symmetrically to them similarly to the independent supply ports 303. Since the liquid generally has a characteristic that viscosity lowers in a case where a temperature rises, in a case where the liquid is heated by the sub-heaters arranged asymmetrically to the heaters, a balance of viscosity is lost right and left, and a liquid foaming shape becomes asymmetrical. As a result, it is likely that impact position accuracy on the paper surface of the ejected liquid droplet lowers. Thus, in this embodiment, by arranging the sub-heaters 305 symmetrically to the heaters 304 (ejection ports), an influence on the impact accuracy of the liquid droplet even in the case of heating by the sub-heater is reduced.

A Driver 306 is arranged on an outer side of the independent supply port 303, and the sub-heater 305 and the driver 306 are connected by a wiring 311. The wiring 311 has resistance sufficiently lower than those of the sub-heater 305 and the driver 306, and an influence of heat generation is small. The driver 306 may be arranged in a vicinity of the heater 304, but in that case, a distance between the heater 304 and the independent supply port 303 is increased, and there is a concern that supply of the liquid after ejection is delayed. Thus, this embodiment has a constitution with an emphasis on liquid ejection performances by arranging the driver 306 on the outer side of the independent supply port 303. Moreover, the driver 306 is arranged on the outer side of the independent supply port 303, that is, a row 303*a* of the independent supply ports 303 is provided between a row 304*a* of the heaters 304 as well as a row 305*a* of the sub-heaters 305 and a row 306*a* of the drivers 306. As a result, since a distance between the sub-heater 305 as well as the heater 304 which are heat sources and the driver 306 can be increased, an influence of heating on the driver 306 can be suppressed, and more reliable driving can be performed.

In the print element substrate 301, an end-portion heating area 307 (that is, a heating area arranged on an end portion in a row direction of the heaters 304) provided adjacent to the pad 102 is narrower than other heating areas 308 not adjacent to the pad 102. This is because, since heat is radiated through an electrical connection portion in the vicinity of the pad 102, a temperature distribution gradient becomes larger than in the other areas, and this influence is to be suppressed. Thus, a control area of the end-portion heating area 307 is made small. On the other hand, since a portion far away from the pad 102 has a relatively gentle temperature gradient, the control area of the heating area 308 can be made relatively large. Note that, similarly to the aforementioned embodiment, the four drivers 306 arranged in one end-portion heating area 307 are controlled by the same sub-heater control signal 108. Moreover, eight drivers 306 arranged in one another heating area 308 are controlled by the same sub-heater control signal 108. As described above, the number of the sub-heaters 305 and the number of the drivers 306 included in one end-portion heating area 307 are smaller than the number of the sub-heaters 305 and the number of the drivers 306 included in the other heating areas 308.

Moreover, the heating areas in the print element substrate 301 are made common in an A row and a B row as well as in a C row and a D row in a long side direction. Moreover, the liquid in the same color is supplied to the A row and the B row as well as the C row and the D row, respectively, in this embodiment. Since the liquid ejection driving of the row in the same color is assigned equally to an image in the rows, a temperature-rise profile and heat distribution between the rows in the same color are substantially the same. Thus, a temperature detection element 309 is arranged only on the A row and the C row which are typical in this embodiment, and the heating areas are also made common in the rows in the same color.

FIG. 3C is a view illustrating a circuit for driving the sub-heater 305 in the print element substrate 301. In the end-portion heating area 307, four units 310 are controlled by the same sub-heater control signal 108. On the other hand, in the heating area 308, the eight units 310 are controlled by the same sub-heater control signal 108. Calorific values of all the units 310 are equal, and only the number of the units 310 to be connected per one sub-heater control signal 108 is changed.

By making a heating amount per area equal regardless of a location as described above, a temperature control sequence is simplified. Even in a case where there is a plurality of types of the sub-heaters 305 and calorific values are different depending on the area, temperature control needs to be executed by referring to a plurality of control tables according to the types of the sub-heaters 305. However, since the calorific value in each unit 310 is uniform in the constitution of the present invention, temperature control can be executed by one type of a control table.

A plurality of the temperature detection elements 309 is arranged at the same position with respect to the unit 310. As a result, the temperature detection element 309 is equally influenced by heating of the sub-heater 305 and thus, fluctuation in temperature accuracy due to the position of the temperature detection element 309 can be suppressed.

As described above, the independent supply ports and the sub-heaters are arranged on both sides of the heater symmetrically to the heater, and the heaters 104, the sub-heaters 105, and the drivers 106 are arranged for each of the heating areas 107. Further, while the plurality of heating areas 107 is arrayed on the print element substrate, the number of units which can be controlled by the same sub-heater control signal is reduced in the vicinity of the connection terminals.

As a result, the print element substrate and the printing device which can suppress lowering of the image quality were realized.

Note that this embodiment has a constitution in which the rows of the independent supply ports 303 are arranged on the both sides of the heaters 304 (heater row), but the row of the independent supply ports 303 on one side of the row of the heaters 304 may be made a row of discharge ports for discharging the liquid. That is, it is only necessary to have a constitute in which opening rows through which the liquid passes such as the rows of the supply ports 303 and the row of the discharge ports are arranged on the both sides of the row of the heaters 304. As a result, the liquid can be circulated through the supply port 303, the heater 304, and the discharge port.

Fourth Embodiment

A fourth embodiment of the present invention will be described below by referring to the drawings. Note that, since a basic constitution of this embodiment is similar to that of the first embodiment, only characteristic constitution will be described below.

Figure 4:
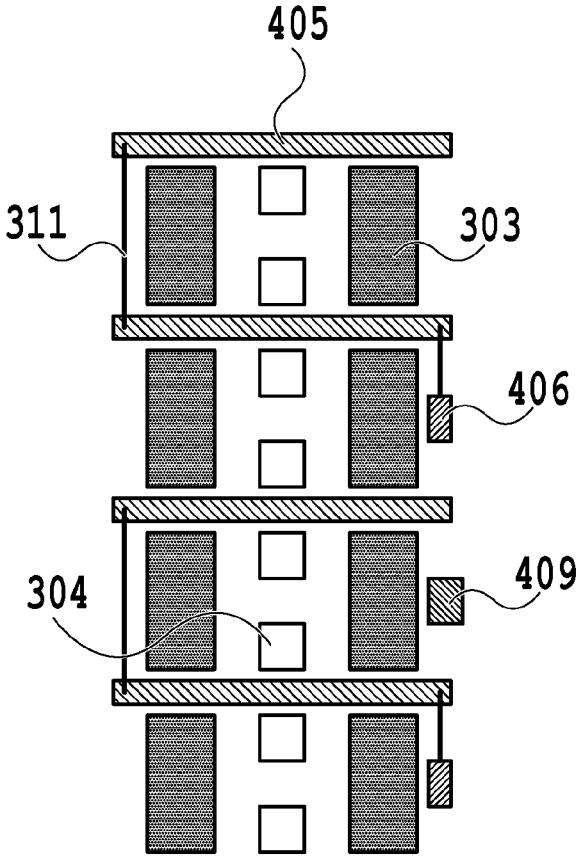
FIG. 4 is a view illustrating layout of the heating area in the print element substrate.

FIG. 4 is a view illustrating a layout of a heating area in a print element substrate of this embodiment. Since the layout or a circuit diagram of the heater and the independent supply port on the print element substrate is not largely different from those of the third embodiment, it is omitted. In this embodiment, sub-heaters 405 are provided so as to pass between the heaters 304 in an array direction of the heaters 304 and between the independent supply ports 303. That is, the sub-heaters 405 extend along a direction (an orthogonal direction in this embodiment) crossing the array direction of the heaters 304. Moreover, the sub-heaters 405 are provided so as to cross the row of the heaters 304 and the row of the independent supply ports 303. Each of the sub-heaters 405 as well as the sub-heaters 405 and drivers 406 are connected by the wiring 311. The wiring 311 has a resistance value lower than the sub-heater 405 and the driver 406 and has less influence of heat generation.

The constitution of the print element substrate in this embodiment can reduce a distance between the independent supply port 303 and the heater 304 more than the constitution in FIG. 3B, and higher speed ejection can be realized by improving ink supply capability to the ejection port.

As described above, the independent supply ports are arranged on the both sides of the heaters symmetrically to them, and the sub-heaters 405 are provided so as to pass between the independent supply ports 303 in the array direction of the heaters 304. Further, while the heater 104, the sub-heater 105, and the driver 106 are arranged in each of the heating areas 107, and the plurality of heating areas 107 is arrayed on the print element substrate, the number of units capable of being controlled by the same sub-heater control signal is reduced in the vicinity of the connection terminal. As a result, the print element substrate and the printing device which can suppress lowering of the image quality were realized.

Print Head and Printing Device

Examples of an inkjet print head on which the print element substrate of the aforementioned embodiment is mounted and the printing device using this inkjet print head will be described.

Figure 5A:
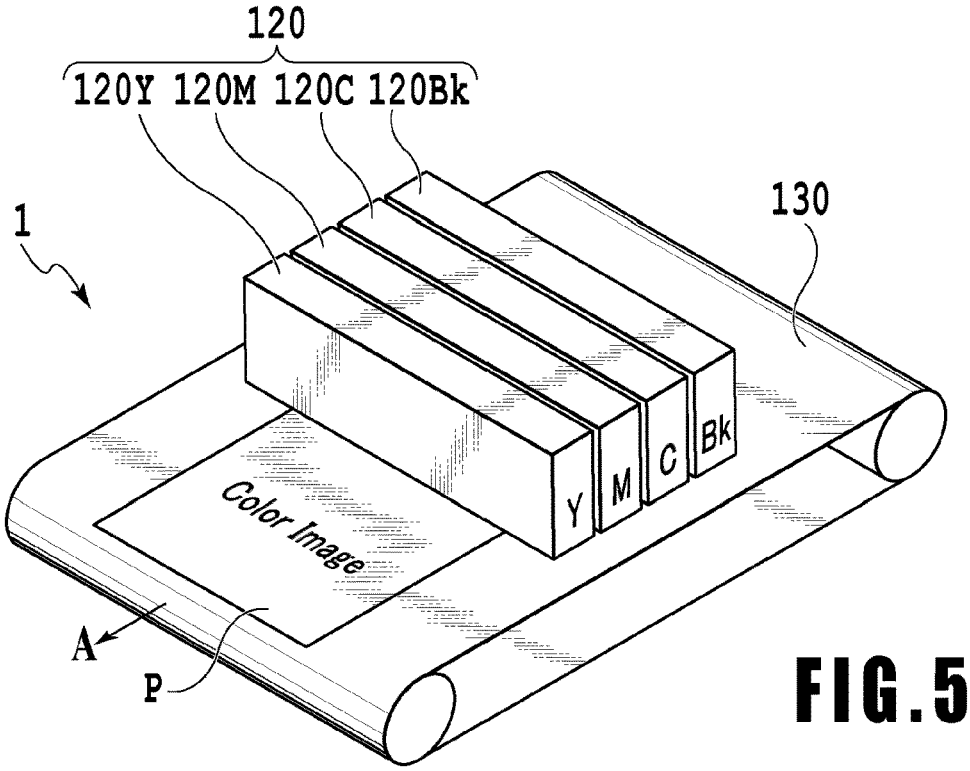
FIG. 5A is a view illustrating a constitution example of a printing device.

FIG. 5A is a schematic perspective view for explaining a constitution example of an inkjet printing device 1 using an inkjet print head 120. The printing device 1 of this example is of a so-called full-line type, and a lengthy print head 120 extending over the whole region in a width direction of a print medium P is used. The print medium P is continuously conveyed in an arrow. A direction by a conveyance mechanism 130 using a conveyance belt or the like. While the print medium P is being conveyed in the arrow A direction, an ink (liquid) is ejected from the print head 120 so that an image is printed on the print medium P. In the case of this example, a color image can be printed by using print heads 120C, 120M, 120Y, and 120Bk ejecting inks in cyan (C), magenta (M), yellow (Y), and black (K), respectively, as the print head 120.

Figure 5B:
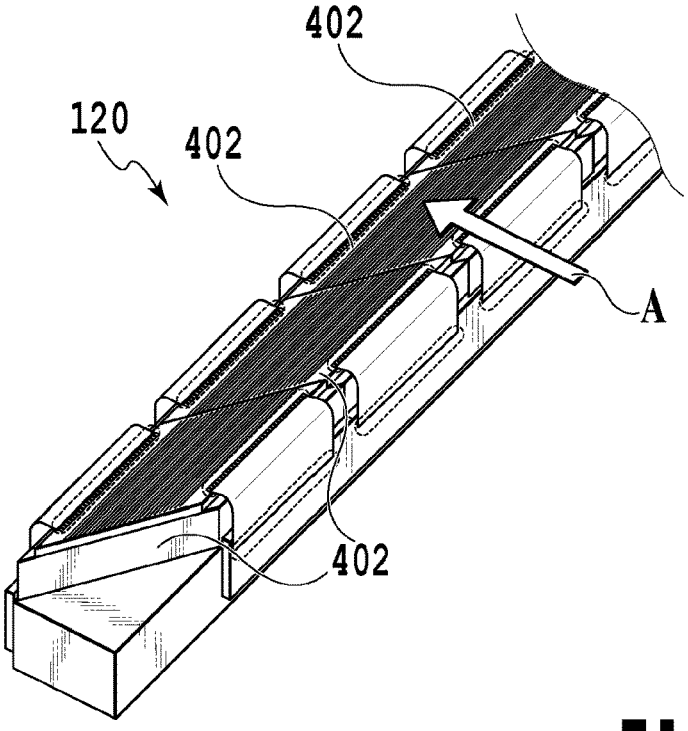
FIG. 5B is a view illustrating a constitution example of a print head.

FIG. 5B is a perspective view of the print head 120. The print head 120 of this example is a full-multi head in which a plurality of print element substrates 402 is arranged along a direction crossing (substantially orthogonal to, in the case of this example) the conveyance direction (the arrow A direction) of the print medium P. The substrate 402 includes a heater as a generation element of ejection energy for ejecting ink. As the ejection energy generation element, various elements, such as a piezo element, can be used. Moreover, an ejection port corresponding to the heater (element) is formed on a top plate, not shown, and a pressure chamber is formed between the top plate and the substrate 402. FIG. 5B illustrates the substrate 402 having a parallelogram shape whose interior angle is not a right angle, but it may be a rectangular substrate as illustrated in the aforementioned embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-107638, filed May 30, 2016, and No. 2017-088816, filed Apr. 27, 2017, which are hereby incorporated by reference wherein in their entirety.

What is claimed is:

1. A print element substrate which ejects a liquid droplet from an ejection port by foaming the liquid comprising:

a first heating unit row in which a plurality of first heating units used for foaming the liquid is arrayed;

a second heating unit row in which a plurality of second heating units provided in a vicinity of the first heating units and used for heating the print element substrate is arrayed along the first heating unit row; and a driving unit row in which a plurality of driving units which switch on/off the second heating units is arrayed along the first heating unit row.

2. The print element substrate according to claim 1, wherein at least one of the first heating units, at least one of the second heating units, and at least one of the driving units are provided in a predetermined region;

the driving unit in the region switches on/off the second heating unit in the region; and a plurality of the regions is arrayed, and the first heating unit row, the second heating unit row, and the driving unit row are formed therein.

3. The print element substrate according to claim 2, further comprising a temperature detecting unit detecting a temperature of the print element substrate, wherein the temperature detecting unit is provided in the region.

4. The print element substrate according to claim 3, wherein a plurality of the regions each having an equal positional relationship among the first heating unit, the second heating unit, the driving unit, and the temperature detecting unit is arrayed.

5. The print element substrate according to claim 4, wherein the positional relationship among the first heating unit, the second heating unit, the driving unit, and the temperature detecting unit is equal in all the regions.

6. The print element substrate according to claim 2, wherein each of the regions is capable of switching on/off the second heating unit.

7. The print element substrate according to claim 6, wherein a plurality of connection terminals is provided on an end portion; and the numbers of the second heating units and the driving units in the region adjacent to the connection terminal are smaller than the numbers of the second heating units and the driving units in the region not adjacent to the connection terminal.

8. The print element substrate according to claim 6, wherein the liquid is an ink and a plurality of the first heating units in the region is capable of ejecting the ink in the same color.

9. The print element substrate according to claim 2, wherein a plurality of the driving units and a plurality of the second heating units corresponding to the driving units are provided in the region, and the driving units switch on/off the second heating units corresponding to the driving units based on a signal common to the plurality of the driving units in the region.

10. The print element substrate according to claim 1, wherein one of the driving units switches on/off one of the second heating units.

11. The print element substrate according to claim 1, wherein one of the driving units switches on/off a plurality of the second heating units.

12. The print element substrate according to claim 1, further comprising a supply port extending along the first heating unit row, wherein a liquid supplied from the supply port is ejected.

13. The print element substrate according to claim 1, further comprising an opening row in which a plurality of openings through which a liquid passes is arrayed along the first heating unit row.

14. The print element substrate according to claim 13, wherein the opening rows are provided symmetrically on both sides of the first heating unit row.

15. The print element substrate according to claim 13, wherein the second heating unit row is provided between the first heating unit row and the opening row.

16. The print element substrate according to claim 13, wherein the opening row is provided between the first heating unit row and the driving unit row.

17. The print element substrate according to claim 1, wherein a power supply supplied to the second heating unit is the same power supply as the power supply supplied to the first heating unit.

18. The print element substrate according to claim 1, wherein the driving units switches on/off the second heating units based on a signal to control the second heating units.

19. The print element substrate according to claim 1, wherein the driving unit row is provided on one side of the second heating unit row.

20. A printing device comprising:

a print element substrate which ejects a liquid droplet from an ejection port by foaming the liquid, the print element substrate including a first heating unit row in which a plurality of first heating units used for foaming the liquid is arrayed, and a second heating unit row in which a plurality of second heating units provided in a vicinity of the first heating units and used for heating the print element substrate is arrayed along the first heating unit row; and a driving unit row in which a plurality of driving units which switch on/off the second heating units is arrayed along the first heating unit row, in the print element substrate.

* * * * *